US005611237A

United States Patent [19]

Harper

[11] Patent Number: 5,611,237

[45] Date of Patent: Mar. 18, 1997

[54] BENDING TOOL

[76] Inventor: Robert G. Harper, 48719 Morris Rd., Hammond, La. 70401

[21] Appl. No.: 540,465

[22] Filed: Oct. 10, 1995

[51] Int. Cl.[6] ..... B21D 1/12

[52] U.S. Cl. ..... 72/458; 72/479

[58] Field of Search ..... 72/458, 478, 479

[56] References Cited

U.S. PATENT DOCUMENTS

| | | | |
|---|---|---|---|
| 63,474 | 4/1864 | Connolly . | |
| D. 297,103 | 8/1988 | Parish, Sr. . | |
| 329,713 | 11/1885 | Caldwell | 72/458 |
| 927,653 | 7/1909 | Heckman . | |
| 1,326,907 | 1/1920 | Bond | 72/458 |
| 2,222,081 | 11/1940 | Leigh | 72/458 |
| 2,637,292 | 5/1953 | George, Jr. . | |
| 2,938,413 | 5/1960 | Pauls . | |
| 3,541,836 | 11/1970 | Meis . | |
| 4,034,595 | 7/1977 | Smith . | |
| 4,181,002 | 1/1980 | Eckhold et al. . | |
| 4,191,043 | 3/1980 | Schaffer | 72/458 |
| 4,619,132 | 10/1986 | McBee | 72/458 |
| 4,934,174 | 6/1990 | Gronlund et al. . | |
| 4,934,175 | 6/1990 | Hensler et al. | 72/458 |
| 5,052,209 | 10/1991 | DeMaagd | 72/458 |
| 5,394,729 | 3/1995 | Eisenhower, Jr. . | |

FOREIGN PATENT DOCUMENTS

| | | | |
|---|---|---|---|
| 562642 | 6/1975 | Switzerland . | |
| 495345 | 11/1938 | United Kingdom | 72/458 |
| 82/03805 | 11/1982 | WIPO . | |

*Primary Examiner*—David Jones
*Attorney, Agent, or Firm*—Richard C. Litman

[57] ABSTRACT

A novel tool and method for making the tool for bending roofing material having uniformly spaced support ribs. The bending tool has a channel for bending roofing material having uniformly spaced support ribs. The dimensions of the channel height and length are based on properties of the ribs of the roofing material on which the tool is to be used, specifically the height of the ribs and the distance between two consecutive ribs. The tool is made by taking these measurements of the ribs and fabricating a channel based on these measurements. The channel is formed by two flanges attached to a solid upper base. The entire base is attached to a handle.

4 Claims, 4 Drawing Sheets

20
22
10
16
18
14
12

BENDING TOOL

BACKGROUND OF THE INVENTION

1. Field of the Invention

The present invention relates to a bending tool for roofing material and a method for making the tool.

2. Description of the Prior Art

The bending tool is used to bend the end of a metal roof panel to the height of the major rib of the roofing panel to prevent water from blowing under the flashing. Water blowing under the flashing allows the water to enter the structure and is a common problem with metal roofing. The manufacturers of metal panels recommend that the sheets be bent to prevent water from entering the structure. Heretofore, there have been no such tools for bending metal roofing. The present invention provides a tool with a channel that solves this problem.

U.S. Pat. No. Des. 297,103, issued on Aug. 9, 1988 to Theodore S. Parish, Sr., shows a sheet metal bending pliers which clamps down upon tightening of a screw. It is not designed to bend metal roofing because it would be tedious and time-consuming due to the clamping device that would have to be opened and closed. Further, there is nothing to limit the height which the pliers bend the sheet metal. The channel of the instant invention eliminates any clamping, which would be harmful to the roofing material, and limits the height to which the roof panel is bent to the height of the channel.

Other prior art patents designed for bending sheet metal do not contemplate bending of a roof panel, much less bending it to a certain height. Such tools exhibit many problems which the instant invention is designed to solve. The tools in many of these patents are too narrow to provide a uniform bend. They must be used several times over a section, a time-consuming and arduous task. The present invention is wide enough to bend an entire section of a roof panel (the portion between two major ribs).

Further, many of these prior tools have a groove which is too shallow, resulting in an inability of the tool to bend a roofing panel to the desired height. Finally, the tools in other patents are not adapted to accept a roofing panel; rather they are designed for sheet metal. In contrast the instant tool contains a channel which is configured to accept a roofing panel and bend it to a predetermined height.

SUMMARY OF THE INVENTION

The invention is a bending tool and method of making a bending tool. The bending tool has a channel for bending roofing material having uniformly spaced support ribs. The dimensions of the channel height and length are based on properties of the ribs of the roofing material on which the tool is to be used, specifically the height of the ribs and the distance between consecutive ribs. The tool is made by taking these measurements of the ribs and fabricating a channel based on these measurements. The channel is formed by two flanges attached to a solid upper base. The entire base is attached to a handle.

Accordingly, it is a principal object of the invention to provide a tool for bending roofing panels constructed with ribs.

It is another object of the invention to provide a roof-bending tool in which a certain section of a roof can be bent as one uniform piece.

It is a further object of the invention to provide a bending tool in which the roofing can be bent to a certain height.

Still another object of the invention is to provide a method for making a bending tool for bending a roof based on certain parameters of the ribs of the roof.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
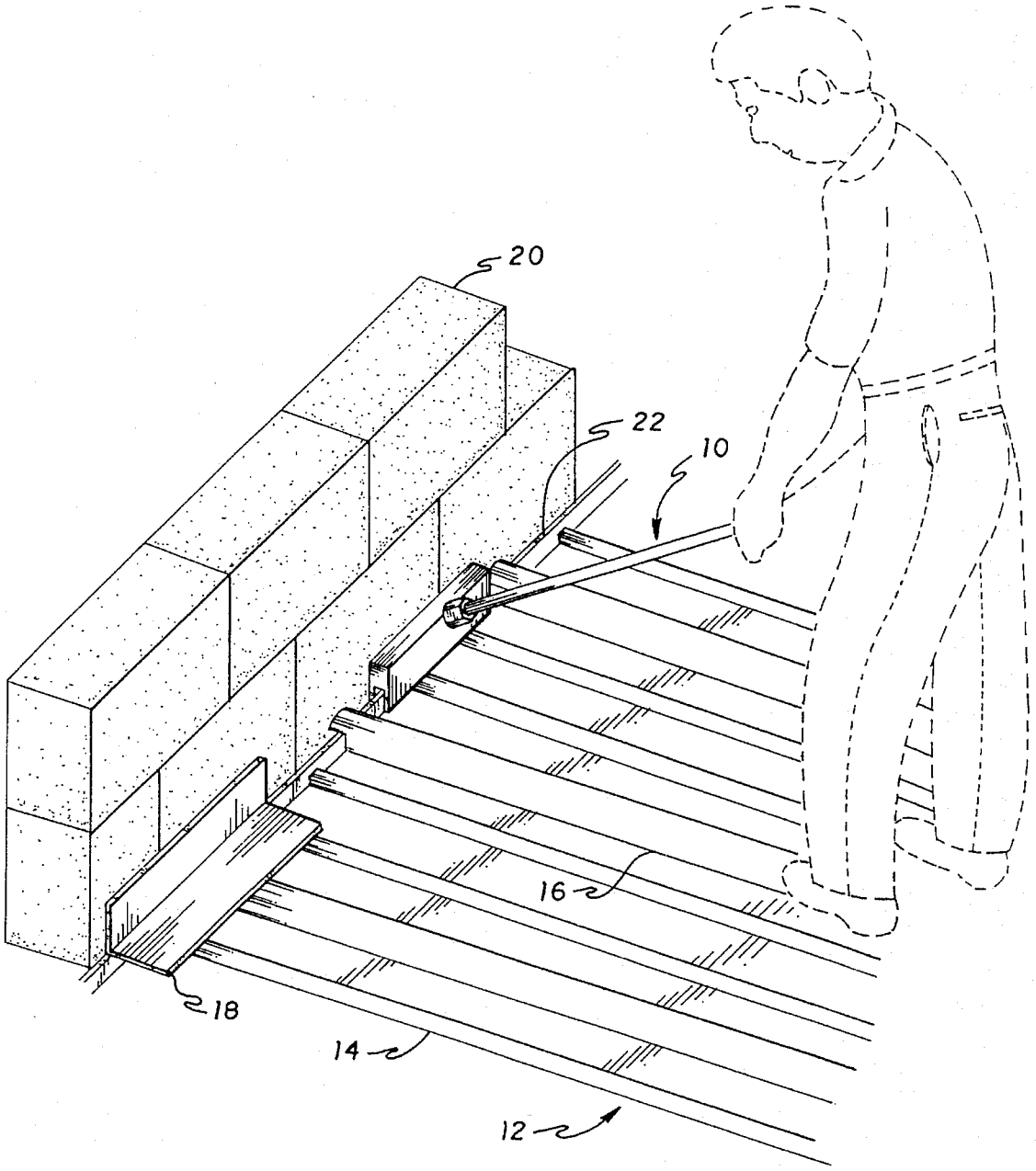
FIG. 1 is an environmental perspective view of a roof bending tool in use and which shows the roofing material having bent ends.

The present invention relates to a bending tool for roofing material having ribbing. Many metal roofing materials have ribs for reinforcement, to keep it from being flaccid, and to provide a support structure. These ribs are seen in FIG. 1 as major ribs 16 and minor ribs 14. It is desirable to provide a means to prevent water which has accumulated between the major ribs 16 from entering a structure. A rubber closure strip that fits between the front of the flashing and the roofing material has been designed to prevent water from blowing underneath the flashing. However, problems with this closure, such as sun deterioration and birds pecking at it, warrant another type of solution. A solution which is provided by the instant invention. The provision of a water-impervious system including a bend 22 in the roofing material 12 over which flashing 18 is placed (as seen in FIG. 1) will achieve this protection from water entry.

The end of the roofing material 12 near the parapet wall 20 must be bent upwards to a height equal to that of the major ribs 16. If the bend 20 is lower than the major ribs 16, water trapped between the major ribs 16 may get between the flashing 18 and the bend 22 and run down the parapet wall 20 and into the structure. If the bend 22 is higher than the major ribs 16, the flashing 18 will not be level with respect to the major ribs 16 and will not be flush against the parapet wall 20. Water may be trapped between the flashing 18 and the parapet wall 20 and run down the parapet wall and into the structure. Thus, it is critical that the bend 22 in the roofing material 12 is neither higher nor lower than the major ribs 16.

The bending tool 10 of the instant invention allows a user to make a bend 22 of the appropriate height in the roofing material 12. To use the tool 10 while the roofing material is in place, there must be a gap to allow a user to fit the base 32 of the bending tool 10 between the parapet wall 20 and the roofing material 12. Alternatively, the roofing material 12 may be bent before it is installed on the roof.

Figure 2:
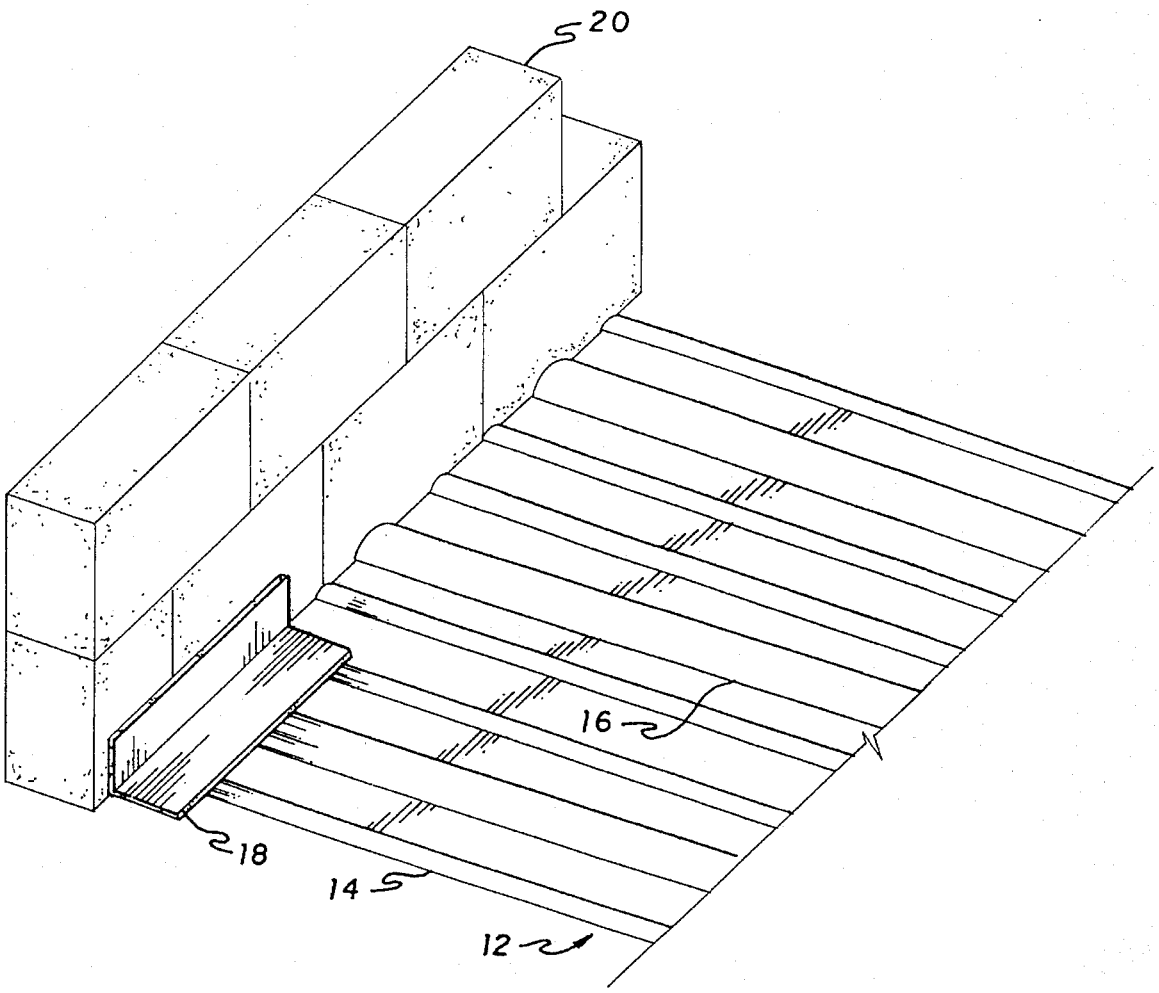
FIG. 2 is a perspective view of the roofing material in which the ends have not been bent.
Figure 3:
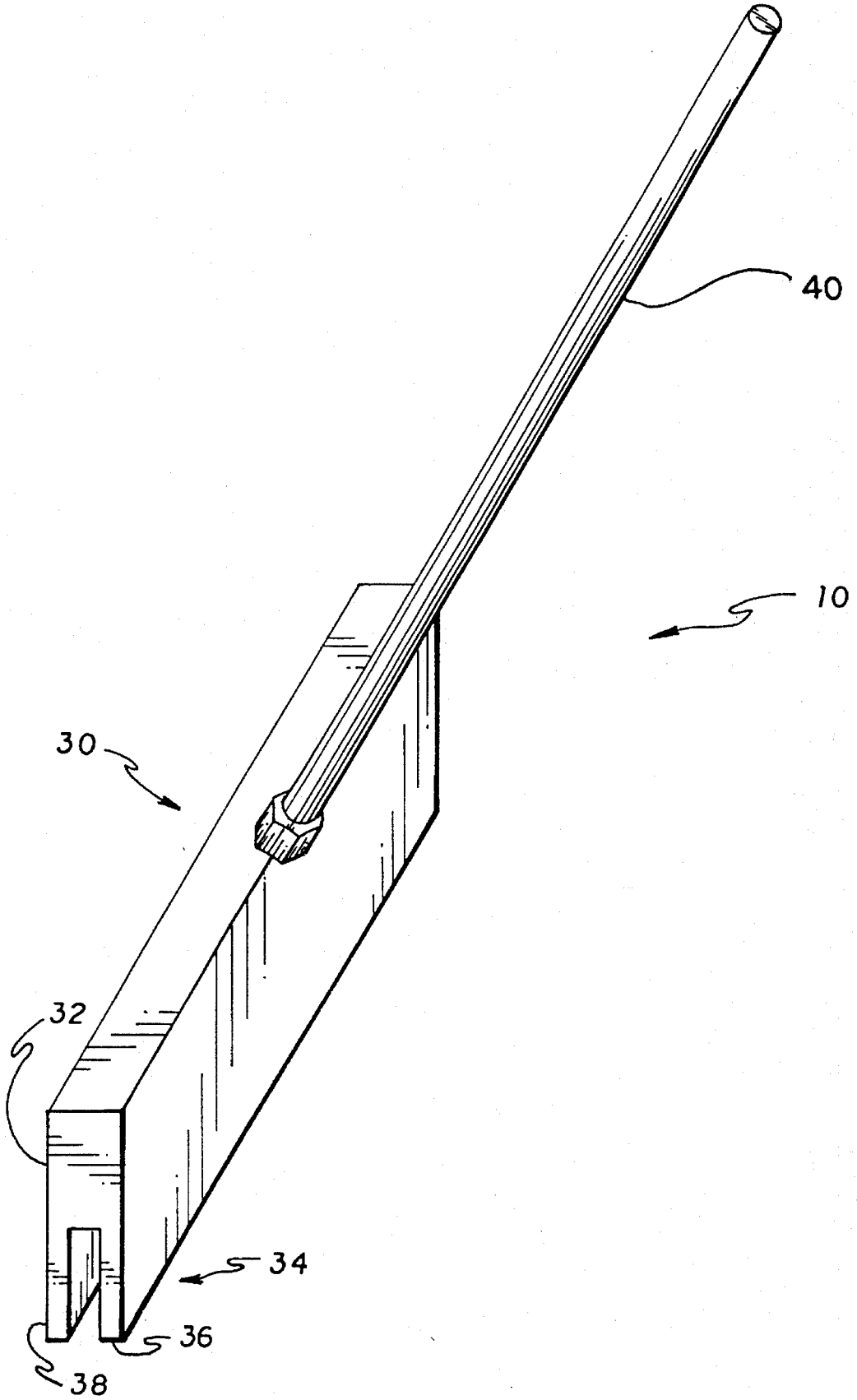
FIG. 3 is a perspective view of the bending tool.
Figure 4:
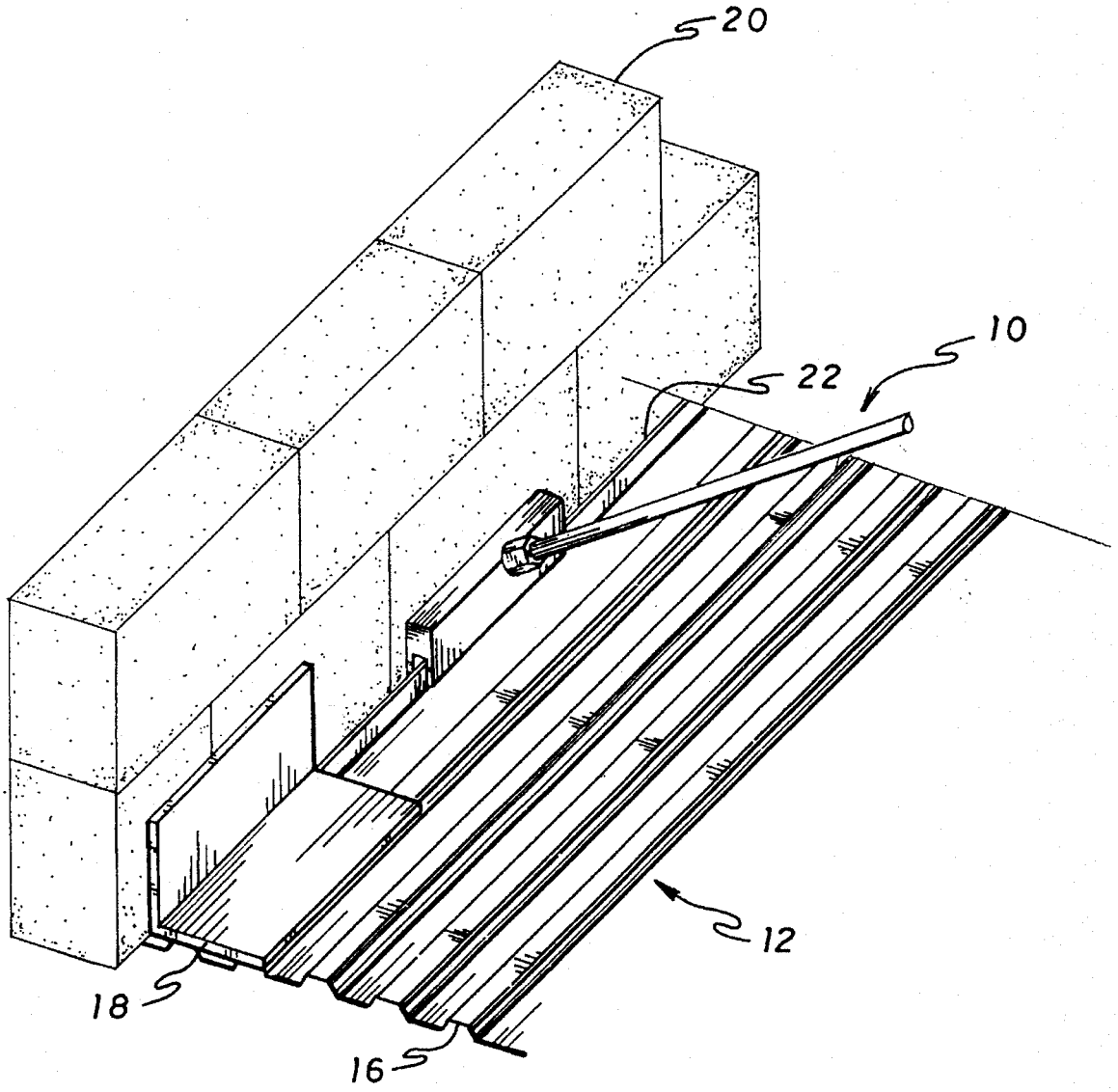
FIG. 4 is a perspective view of a roof in which the ends have been bent and which has its ribs parallel to the parapet wall.

FIG. 2 illustrates that when a bend 22 is not provided, there is a gap between the roofing material 12 and the flashing 18, allowing the water which is trapped between the major ribs 16 to get in between the flashing 18 and the roofing material allowing water to get into the structure. FIG. 4 illustrates that the bending height is also significant in roofing material that has major ribs 16 running parallel to the parapet wall Turning to the structure of the bending tool 10 and the manner in which it bends roofing material 12 to the exact height required, the tool 10 includes a handle 40 threadedly connected to a base 30. FIG. 3 depicts the elements of the tool 10. The base 30 includes an upper 32 and a lower portion 34. The lower portion of the base 34 includes right and left flanges 36 and 38, which form a channel. The flanges 36 and 38 are the same height as the major ribs 16 on the roofing material 12 on which the tool 10 will be used. Thus, a portion of the roofing material 12 which is fully inserted into the channel and bent will have a bend 22 which has exactly the same height as each of the major ribs 16.

The length of the channel formed by the flanges 36 and 38 is equal to the spacing between two major ribs 16. However, in the case of ribs parallel to the wall (as seen in FIG. 4), the length has less significance and only the height of the channel is important. A tool 12 having a channel of this length, which may be adjusted depending on the spacing of the major ribs in different brands of metal roofing material, allows the installer to make one bend per section between major ribs, thus reducing the time to perform the arduous task of bending the roofing material and insuring uniformity across the bend.

To make this highly useful tool 10, measurements of the height of a major rib 16 and the distance between consecutive major ribs 16 must be taken. Based on these measurements, flanges 36 and 38 forming a channel having the required height and length are fabricated as part of a lower base 34. The lower base 34 is connected to an upper base 32 and the entire base 30 is attached to a handle 38.

It is to be understood that the present invention is not limited to the sole embodiment described above, but encompasses any and all embodiments within the scope of the following claims.

I claim:

1. A tool for bending the ends of metal roofing material having support ribs positioned along said material comprising:

a parallelepiped unitary base having an upper portion having a rectangular cross section and a lower portion, said lower portion having two parallel flanges, each said flange having a height, length, and depth, said flanges being separated and forming a channel having parallel side walls, the height of said flanges being equal to the height of said support ribs and an elongated handle attached to said base at an acute angle to a vertical plane which bisects said channel.

2. The tool according to claim 1 wherein said ribs are uniformly spaced and the length of said flanges is equal to the distance between any two of said uniformly spaced support ribs.

3. The tool of claim 1 wherein said handle is removably attached to said base.

4. The tool of claim 3 wherein said handle is threadedly attached to said base.

* * * * *